US010989190B2

(12) United States Patent
Ochsenkühn

(10) Patent No.: US 10,989,190 B2
(45) Date of Patent: Apr. 27, 2021

(54) EXTERNAL GEAR PUMP

(71) Applicant: AUDI AG, Ingolstadt (DE)

(72) Inventor: Simon Ochsenkühn, Altdorf (DE)

(73) Assignee: AUDI AG, Ingolstadt (DE)

( * ) Notice: Subject to any disclaimer, the term of this patent is extended or adjusted under 35 U.S.C. 154(b) by 299 days.

(21) Appl. No.: 15/779,170

(22) PCT Filed: Nov. 28, 2016

(86) PCT No.: PCT/EP2016/002007
§ 371 (c)(1),
(2) Date: May 25, 2018

(87) PCT Pub. No.: WO2017/092862
PCT Pub. Date: Jun. 8, 2017

(65) Prior Publication Data

US 2018/0347561 A1 Dec. 6, 2018

(30) Foreign Application Priority Data

Dec. 4, 2015 (DE) ..... 10 2015 015 752.3

(51) Int. Cl.
*F04C 2/20* (2006.01)
*F04C 2/08* (2006.01)
(Continued)

(52) U.S. Cl.
CPC ..... *F04C 2/20* (2013.01); *F04C 2/084* (2013.01); *F04C 15/0049* (2013.01)

(58) Field of Classification Search
CPC ..... F04C 2/20; F04C 2/084; F04C 15/0049; F04C 2/088; F04C 2/102; F04C 2/082; F04C 18/20
(Continued)

(56) References Cited

U.S. PATENT DOCUMENTS 294,026 A 2/1884 Fitts
1,686,867 A 10/1928 Kuhn
(Continued)

FOREIGN PATENT DOCUMENTS

CN 102900666 A 1/2013
DE 2242269 A1 3/1973
(Continued)

OTHER PUBLICATIONS

German Search Report dated Oct. 24, 2017 of corresponding German application No. 102016014175.1 of which priority application No. is 102015015752.3; 5 pgs.
(Continued)

*Primary Examiner* — Deming Wan
(74) *Attorney, Agent, or Firm* — Maier & Maier, PLLC

(57) ABSTRACT

An external gear pump, having a driving first pump gear and a second pump gear driven by the first pump gear, which intermesh to convey a fluid from a suction side to a pressure side of the external gear pump. The first pump gear and the second pump gear each have a plurality of teeth, each having a leading tooth flank leading in the rotation direction of the corresponding pump gear and a trailing tooth flank. The leading tooth flank of the first pump gear interacts with the trailing tooth flank of the second pump gear to drive the second pump gear via the first pump gear. The trailing tooth flanks of the first pump gear extend concavely to form a fluid pocket at at least one axial position in the radial direction at least in sections in each case.

14 Claims, 3 Drawing Sheets

(51) Int. Cl.
*F04C 15/00* (2006.01)
*F04C 2/10* (2006.01)

(58) Field of Classification Search
USPC ..... 418/206.5
See application file for complete search history.

(56) References Cited

U.S. PATENT DOCUMENTS

| | | | | | |
|---|---|---|---|---|---|
| 3,709,055 | A * | 1/1973 | Grove | F16H 55/08 | 74/462 |
| 3,817,117 | A | 6/1974 | Kita et al. | | |
| 3,953,160 | A | 4/1976 | Bottoms | | |
| 3,981,646 | A | 9/1976 | Bottoms | | |
| 4,233,005 | A * | 11/1980 | Bottoms | F04C 2/088 | 418/190 |
| 4,460,322 | A | 7/1984 | Schibbye et al. | | |
| 6,146,121 | A * | 11/2000 | Fox | F04C 2/084 | 418/206.1 |
| 2005/0271538 | A1* | 12/2005 | Knighton | F04C 2/088 | 418/206.1 |
| 2006/0204394 | A1 | 9/2006 | Klassen | | |
| 2011/0083523 | A1* | 4/2011 | Huang | F16H 55/08 | 74/462 |
| 2012/0020825 | A1* | 1/2012 | Friedrich | F04C 14/185 | 418/205 |

FOREIGN PATENT DOCUMENTS

| | | | | | |
|---|---|---|---|---|---|
| DE | 2421891 | A1 | 11/1975 | | |
| DE | 2901179 | A1 | 7/1979 | | |
| DE | 3246685 | A1 | 6/1983 | | |
| DE | 3809721 | C1 | 6/1989 | | |
| DE | 19818027 | A1 | 10/1998 | | |
| DE | 10140066 | A1 | 2/2003 | | |
| DE | 10355214 | A1 | 6/2005 | | |
| EP | 1832750 | A1 | 9/2007 | | |
| FR | 2221632 | A1 | 10/1974 | | |
| GB | 632462 | A * | 11/1949 | F04C 2/088 | |
| WO | 2014199202 | A1 | 12/2014 | | |

OTHER PUBLICATIONS

International Search Report dated Feb. 8, 2017 in corresponding Application No. PCT/EP2016/002007; 12 pgs.

Chinese Office Action dated Feb. 2, 2019, in connection with corresponding CN Application No. 201680070594.0 (14 pgs., including machine-generated English translation).

International Preliminary Report on Patentability dated Jun. 14, 2018 of corresponding International application No. PCT/EP2016/002007; 16 pgs.

* cited by examiner

EXTERNAL GEAR PUMP

FIELD

The invention relates to an external gear pump, having a driving first pump gear and having a second pump gear driven by the first pump gear, which intermesh to convey a fluid from a suction side to a pressure side of the external gear pump, wherein the first pump gear and the second pump gear each have a plurality of teeth, each having a leading tooth flank leading in the rotation direction of the corresponding pump gear and a trailing tooth flank, wherein the leading tooth flank of the first pump gear interacts with the trailing tooth flank of the second pump gear to drive the second pump gear via the first pump gear.

BACKGROUND

The external gear pump serves for conveying the fluid from its suction side to the pressure side. Fundamentally, the fluid or state of aggregation thereof can be chosen at will; however, it is preferably a liquid under normal operating conditions of the external gear pump. The external gear pump is equipped with a plurality of pump gears, namely, the first pump gear and the second pump gear. The first pump gear is preferably driven directly. For example, for this purpose, it is connected to a drive shaft of the external gear pump, in particular rigidly and/or permanently. In contrast, the second pump gear is driven indirectly by the drive shaft, namely, via the first pump gear.

The two gears are each equipped with a plurality of teeth, which, depending on the rotational angle position of the pump gears, engage in one another and interact to convey the fluid from the suction side to the pressure side. Each tooth of the pump gears is equipped with the leading tooth flank and the trailing tooth flank, wherein the leading tooth flank is situated in the front in the rotation direction of the respective pump gear and therefore delimits the tooth in the front or in the rotation direction, whereas the trailing tooth flank is situated in the back in the rotation direction and consequently delimits the tooth in the back or opposite to the rotation direction. If the first pump gear is driven, then the leading tooth flank of a least one tooth of the first pump gear comes into physical contact with the trailing tooth flank of a tooth of the second pump gear. As a result, the second pump gear is driven by the first pump gear.

Known from the prior art is, for example, the publication DE 198 18 027 A1. This relates to a displacement gear pump that can be utilized to pump a hydraulic fluid. The gear pump comprises a driving gear and a driven gear. In a first embodiment, the driving gear has symmetrical teeth, whereas the driven gear has asymmetrical teeth. The asymmetrical teeth of the driven gear comprise working surfaces that have a profile corresponding to the profile of the working and non-working surfaces of the driving gear, but they have a non-working surface that is essentially relieved, so that it is essentially flat in form.

Consequently, in the zone of the pump in which the gears intermesh, a large dead space is created, which essentially prevents the formation of any bubbles. In a second embodiment, the driving gear and the driven gear have non-contacting surfaces, which are essentially flat in form in order to create an even larger dead space and to prevent any cavitation when the teeth are positioned further apart in the axial direction. The suppression of bubble formation essentially makes it possible to exclude any cavitation that might occur at high rotational speeds of the pump. Accordingly, damage due to cavitation at the pump can be prevented.

SUMMARY

The object of the invention is then to propose an external gear pump, which, in comparison to known external gear pumps, has advantages and, in particular, makes possible a greater pressure ratio between the outlet pressure and the inlet pressure and/or exhibits a strongly reduced cavitation tendency, so that the acoustic generation of any undesired noise during its operation is avoided.

This is achieved in accordance with the invention with an external gear pump. It is thereby provided that the trailing tooth flanks of the first pump gear extend concavely at least in sections in the radial direction to form a fluid pocket at at least one axial position in each case.

The trailing tooth flanks of the first pump gear or the trailing tooth flanks of the teeth of the first pump gear, in particular of all teeth of the first pump gear, have a special configuration. A fluid pocket is thereby present in each of the trailing tooth flanks. This results from the fact that the corresponding trailing tooth flank is concave at least in sections and therefore has an arch that, in the circumferential direction, engages in the corresponding tooth. As viewed in cross section with respect to a rotation axis of the first gear pump, the trailing tooth flank is arched in the direction of the leading tooth flank, which delimits the same tooth as well as the trailing tooth flank, so that the fluid pocket is engaged in the tooth. In this respect, the trailing tooth flank is arched in the direction of an engaging flank of the tooth. The arch is present in the radial direction and therefore is present in a cross section through the first pump gear.

In this case, the fluid pocket is present at the at least one axial position. This is understood to mean that the fluid pocket does not necessarily pass through the entire first pump gear or the entire trailing tooth flank in the axial direction, even though this obviously can be the case. Preferably, the fluid pocket passes through the first pump gear or the trailing tooth flank in the axial direction only in part and is therefore closed-edge, at least on one side in the axial direction, in the first pump gear or the trailing tooth flank thereof.

It can be provided that the first pump gear and the second pump gear have the same toothing parameters. The toothing parameters are, for example, the tooth root diameter, the pitch circle diameter, the tip circle diameter, the circular pitch, the tip height, the root height, the tooth width, the pitch, the number of teeth, and/or the module. Preferably, the pump gears or their teeth are designed in such a way that at least one of these toothing parameters and preferably a plurality of the toothing parameters or all of the toothing parameters match. The teeth of the pump gears can fundamentally have any desired kind of toothing, which, however, matches for the two pump gears. For example, as a kind of toothing, it is possible to use a involute toothing, a cycloid toothing, or a circular arc toothing.

Such a configuration of the external gear pump markedly reduces the cavitation tendency, thereby positively affecting the acoustic noise behavior. In this respect, the external gear pump runs markedly more smoothly and consequently more quietly than known external gear pumps. In addition, it is possible with the external gear pump according to the invention to achieve a higher pressure or a greater pressure ratio between the outlet pressure and the inlet pressure.

The inlet pressure is present on the suction side and the outlet pressure is present on the pressure side. On account of the higher pressure or the greater pressure ratio, a very high efficiency results and, in particular, a higher efficiency than in the case of an external gear pump for which the trailing tooth flanks do not extend concavely to create fluid pockets. The higher pressure or the greater pressure ratio is achieved, in particular, in the range in which the external pump is constantly pumping, in which the pressure, namely, the outlet pressure, or the pressure ratio is proportional to the rotational speed of the external gear pump or of the first pump gear.

The proportionality between the pressure or the pressure ratio, on the one hand, and the rotational speed, on the other hand, is afforded, in particular at rotational speeds of the external gear pump in a specific rotational speed range that is upwardly limited by a breakaway speed of the external gear pump. The breakaway speed is the rotational speed above which the two pump gears are shifted in position relative to each other in the axial direction in order to reduce their superposition. For example, until the breakaway speed is reached, the pump gears are therefore present in a first relative position with respect to each other, in which their superposition is constant and/or maximal. The further the rotational speed exceeds the breakaway speed, the further the two gears are deflected from the first relative position in the direction of a second relative position, in which the superposition is less than in the first relative position and, in particular, is minimal.

The speed range can be limited downwardly by a minimum rotational speed of the external gear pump. For example, the minimum rotational speed corresponds to an idling speed of a drive assembly of a drive device, wherein the external gear pump is a component of the drive device and serves, for example, to convey a fluid for the drive assembly. Preferably, the external gear pump is designed as a lubricant pump or the equivalent. Accordingly, the invention is obviously also directed at a drive device for, in particular, a motor vehicle that has a drive assembly—for example, an internal combustion engine—as well as, in particular, an external gear pump in accordance with this description. The drive assembly is supplied with a fluid that is conveyed to it by means of the external gear pump, wherein the fluid is, for example, a lubricant or the like. The external gear pump can obviously be further developed in accordance with the statements made in the scope of this description.

A preferred enhancement of the invention provides that the teeth of the first pump gear are symmetric in design. This is understood to mean, in particular, that, as viewed in cross section, the trailing tooth flank is designed to be symmetric to the leading tooth flank, so that the tooth having the leading tooth flank and the trailing tooth flank is symmetric with respect to a central longitudinal plane. In order to achieve the above-described advantages of the external gear pump, it is therefore solely provided that the trailing tooth flanks of the first pump gear are designed with the fluid pocket. In contrast, the second pump gear has an unchanged toothing throughout, in particular without fluid pockets.

In another embodiment of the invention, it is provided that, as viewed in the axial direction, the fluid pocket in the respective trailing tooth flank of the first pump gear is designed to be open-edge at least on one side and, in particular, only on one side. It has already been noted above that the fluid pocket preferably passes only in part through the first pump gear or the trailing tooth flank in the axial direction. Accordingly, as viewed in the axial direction, it is open-edge only on one side, for example. Obviously, however, it is also possible to realize an embodiment of the external gear pump in which the fluid pocket passes completely through the first pump gear or the trailing tooth flank in the axial direction, so that, as viewed in the axial direction, the fluid pocket is open-edge on both sides.

An enhancement of the invention provides that, as viewed in the axial direction, the trailing tooth flanks of the first pump gear each have a fluid pocket region that accommodates the fluid pocket as well as a contact region that directly adjoins the fluid pocket region, wherein the trailing tooth flanks in the contact region extend convexly and, in particular, are symmetric to the respective leading tooth flanks of the corresponding teeth. In an embodiment of this kind, the fluid pocket therefore passes only in part through the first pump gear in the axial direction. In this case, the fluid pocket is present in the fluid pocket region of the trailing tooth flank. As viewed in the axial direction, the contact region adjoins the latter, so that, for example, the fluid pocket is therefore delimited in the axial direction by the contact region of the trailing tooth flank.

Preferably, the contact region forms a wall, which delimits the fluid pocket and lies in a plane that is perpendicular to the rotation axis or forms only a small angle with it. The small angle can be, for example, at most 20°, at most 15°, at most 10°, at most 5°, at most 2.5°, or at most 1°. In the contact region, in contrast to the fluid pocket region, the trailing tooth flanks extend convexly and are therefore arched outward in the circumferential direction, that is, away from the respective leading tooth flank of the corresponding tooth. For example, as viewed in cross section, the trailing tooth flank of each of the teeth extends symmetrically to the corresponding leading tooth flank of the tooth.

The cross section of the trailing tooth flank and, in particular of the entire tooth of the first pump gear that has the trailing tooth flank is preferably identical throughout in the region of the fluid pocket, that is, in the fluid pocket region, in the axial direction. Alternatively or additionally, this can also apply to the contact region.

In the scope of another embodiment of the invention, it is provided that the first pump gear and the second pump gear can be shifted in position relative to each other in the axial direction with respect to a rotation axis of one of the pump gears in order to adjust a specific superposition, wherein the dimensions of the contact region in the axial direction are chosen in such a way that, for each position of the two pump gears relative to each other, the contact region is present in superposition with the second pump gear in the axial direction.

The adjustment of the specific superposition allows the conveyed volume flow or the conveyed mass flow of the external gear pump to be adjusted. Thus, the larger the superposition is between the two pump gears in the axial direction, the larger is the conveyed volume flow. For example, it is provided that the first pump gear is fixed in position in the axial direction and consequently can only be rotated, for example, in a pump housing of the external gear pump. In contrast, the second pump gear is able to rotate and is mounted in such a way that it can shift in position in the axial direction, preferably likewise in the pump housing.

However, the shift in position of the two pump gears can be limited in such a way that they are always present in superposition with each other at least in part and therefore do not become disengaged in any position of the pump gears relative to each other. Additionally, the contact region can be designed in such a way or its dimensions can be chosen in such a way that, regardless of the position of the pump gears relative to each other, the contact region, as viewed in the axial direction, is always present in superposition with the second pump gear. By means of such an embodiment of the external gear pump, an outstanding reverse rotation capability of the external gear pump is achieved.

For example, it is provided that, in the case of a superposition of the two pump gears that is as small as possible relative to each other, the second pump gear, as viewed in longitudinal section, overlaps the contact region by at least 25%, at least 50%, at least 75%, or at least 100%. Preferably, the second pump gear—again as viewed in longitudinal section—when the superposition is as small as possible—is flush with the contact region.

Another preferred embodiment of the invention provides that a tooth flank wall region of the respective trailing tooth flank of the first pump gear that delimits the fluid pocket extends directly out of a tooth root circle and, in particular, extends out of it tangentially. The tooth flank wall region is the portion of the trailing tooth flank that the fluid pocket delimits in the circumferential direction. The tooth root circle is present in each case between two teeth of the first pump gear or delimits the teeth inwardly in the radial direction. The tooth root circle takes the form of a circle or a segment of a circle and lies over the entire circumference of the first pump gear on the tooth root diameter, at least in sections in each case.

The fluid pocket then begins preferably directly at the tooth root circle, that is, as viewed in cross section, at the tooth root diameter of the first pump gear. Especially preferred, the tooth flank region extends tangentially into the tooth root circle or extends tangentially out of it. In this way, an especially robust embodiment of the external gear pump is realized without any weakening of the teeth due to fluid pockets present in the latter.

In the scope of another embodiment, it is provided that the teeth of the first pump gear each have a tip region, in which the trailing tooth flank is convex and, in particular, is symmetric in design to the corresponding leading tooth flank. It was already pointed out above that the concave course of the trailing tooth flank does not necessarily need to be provided over its entire extent in the radial direction. Instead, the concave course can extend only over a part of the trailing tooth flank in the radial direction. For example, for this purpose, the teeth of the first pump gear each have a tip region at which the concave course of the respective trailing tooth flank ends.

Preferably, therefore, the concave course of the trailing tooth flank and consequently the fluid pocket extends, as viewed in cross section, from the tooth root circle all the way to the tip region. In the tip region, the trailing tooth flank is preferably convex and is therefore arched outward or away from the leading tooth flank that belongs to the same tooth. For example, in this case, the trailing tooth flank is symmetric in design to the leading tooth flank of the same tooth. This makes possible a high conveyed volume flow or a high pump pressure of the external gear pump, wherein the pump pressure is understood to mean the difference between a pressure on the pressure side and a pressure on the suction side.

Another preferred embodiment of the invention provides that, in relation to the difference between the tip circle radius and the root circle radius of the teeth of the first pump gear, the dimensions of the tip region in the radial direction are at least 5%, at least 10%, at least 15%, at least 20%, at least 25%, at least 30%, at least 35%, or at least 40%. As viewed in cross section, the dimensions of the tip region are present between the tip circle of the first pump gear and the side of the fluid pocket that is outer-lying in the radial direction. In other words, the dimensions of the tip region therefore correspond to the tip circle radius of the first pump gear minus the largest extent of the fluid pocket in the radial direction, again as viewed in cross section. If the dimensions of the tip region are then given in relation to the difference between the tip circle radius and the root circle radius, preferably the aforementioned values are obtained.

In the scope of an enhancement of the invention, it is provided that, as viewed in cross section, the tooth flank wall region takes the form of a segment of a circle. As viewed in cross section at least in sections, however, this is preferably the case over the entire extension of the fluid pocket. The design of the tooth flank wall region, which, as viewed in cross section, delimits the fluid pocket in the circumferential direction, in the form of segments of a circle, results in an extremely robust embodiment of the external gear pump.

Finally, in another embodiment of the invention, it is provided that the tooth flank wall region adjoins the tip region via a chamfer or a rounding. Therefore, as viewed in cross section, the transition between the tooth flank wall region and the tip region is not abrupt. Instead—again as viewed in cross section—the chamfer or the rounding between the tooth flank region and the tip region is provided in order to achieve a high strength of the external gear. In principle, the rounding can be chosen at will; for example, it has a radius that, in relation to the dimensions of the tip region, is at least 10%, at least 5%, at least 2.5%, at least 1%, at least 0.5%, at least 0.25%, or at least 0.1%. The chamfer or the rounding is preferably part of the fluid pocket.

BRIEF DESCRIPTION OF THE DRAWING

The invention will be explained in detail below on the basis of the exemplary embodiments illustrated in the drawing, without any limitation of the invention thereby ensuing. Shown are.

DETAILED DESCRIPTION OF THE DRAWING

Figure 1:
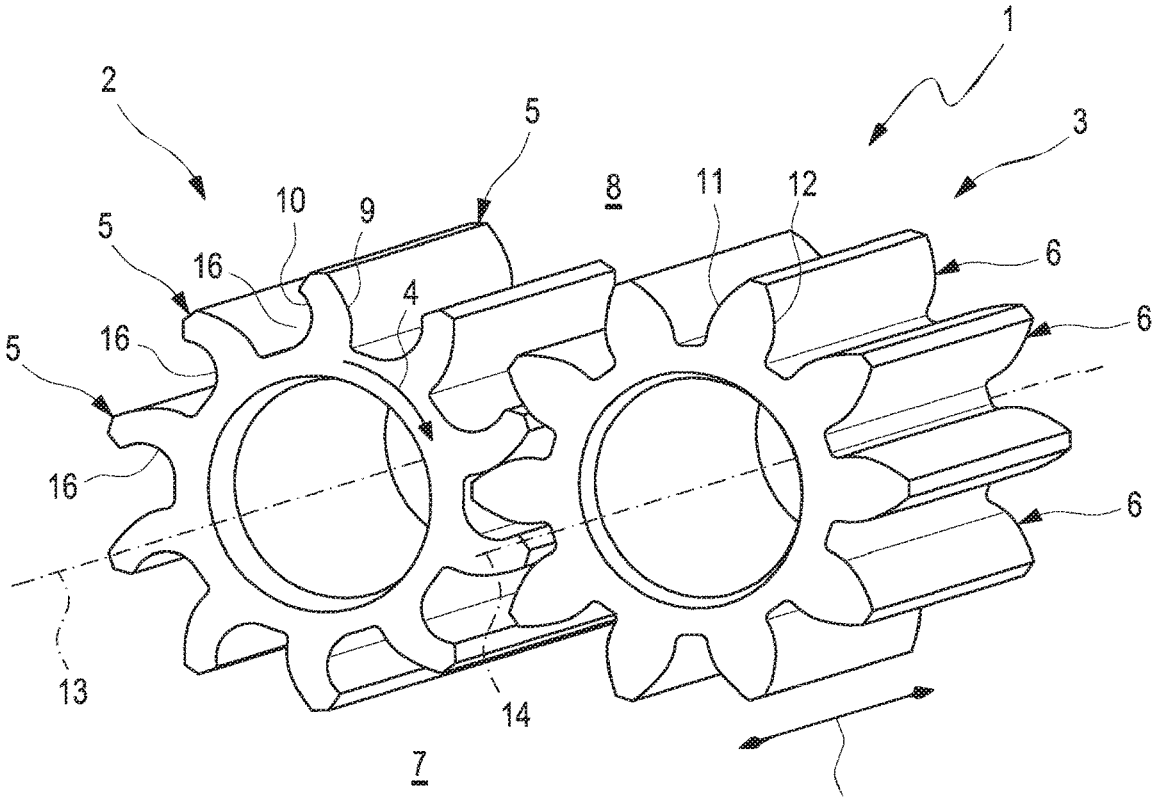
FIG. 1 a region of an external gear pump, namely, a first pump gear as well as a second pump gear, wherein the two pump gears are present in a first position relative to each other.

FIG. 1 shows a part of an external gear pump 1, namely, a first pump gear 2 as well as a second pump gear 3. The first pump gear 2 is designed as a driving pump gear and can therefore be driven directly. In contrast, the second pump gear 3 can be driven only indirectly via the first pump gear 2. A forward rotation direction of the first pump gear 2 is indicated by the arrow 4. The first pump gear 2 has teeth 5, while the second pump gear 3 is equipped with teeth 6, only a few of which are marked respectively by way of example. The pump gears 2 and 3 or their teeth 5 and 6 intermesh, so that, for a rotational movement of the pump gears 2 and 3 in the direction of the arrow 4, a fluid is conveyed from a suction side 7 to a pressure side 8 of the external gear pump 1.

Each of the teeth 5 has a leading tooth flank 9 extending in the rotation direction as well as a trailing tooth flank 10. This is indicted only for one of the teeth 5. Analogously, for this purpose, each tooth 6 of the second pump gear 3 is equipped with a front-lying leading tooth flank 11 leading in the rotation direction and a trailing tooth flank 12. If the rotational movement of the first pump gear 2 occurs in the direction of the arrow 4, then this leading tooth flank 9 of one of the teeth 5 interacts with the trailing tooth flank 12 of one of the teeth 6 in order to drive the second pump gear 3 via the first pump gear 2 and to convey the fluid from the suction side 7 to the pressure side 8.

Whereas both pump gears 2 and 3 are mounted rotatably in, for example, a pump housing (not illustrated here) of the external gear pump 1, they can additionally be shifted in position relative to each other in the axial direction with respect to a rotation axis 13 of the first pump gear 2 or a rotation axis 14 of the second pump gear 3, for example. Preferably, the first pump gear 2 is arranged in fixed position in the axial direction, whereas the second pump gear 3 can be shifted in position in the axial direction. This is indicated by the double arrow 15. In the axial position of the pump gears 2 and 3, illustrated here, there is a maximum superposition of the pump gears 2 and 3 relative to each other in the axial direction. Preferably, the pump gears 2 and 3 have the same dimensions in the axial direction. Obviously, however, it is possible to create different dimensions.

It can be seen that the trailing tooth flanks 10 of the first pump gear 2 extend concavely in the radial direction at least in sections to form a respective fluid pocket 16. This means that, as viewed in cross section with respect to one of the rotation axes 13 and 14, the trailing tooth flanks 10 of the first pump gear 2 are arched in the direction of leading tooth flank 9 of the corresponding tooth 5, so that the fluid pocket 16 or the fluid pockets 16 are created. As a result of a design of this kind, it is possible to reduce markedly the cavitation tendency of the external gear pump 1 and thereby positively affect the noise behavior. In addition, in the embodiment of the external gear pump 1 illustrated here, in which the pump gears 2 and 3 can shift in position relative to each other in the axial direction, it is possible to achieve a very fast vibration decay behavior following a cold start of an internal combustion engine for which the external gear pump 1 is utilized, for example, as a lubricating oil pump.

Figure 2:
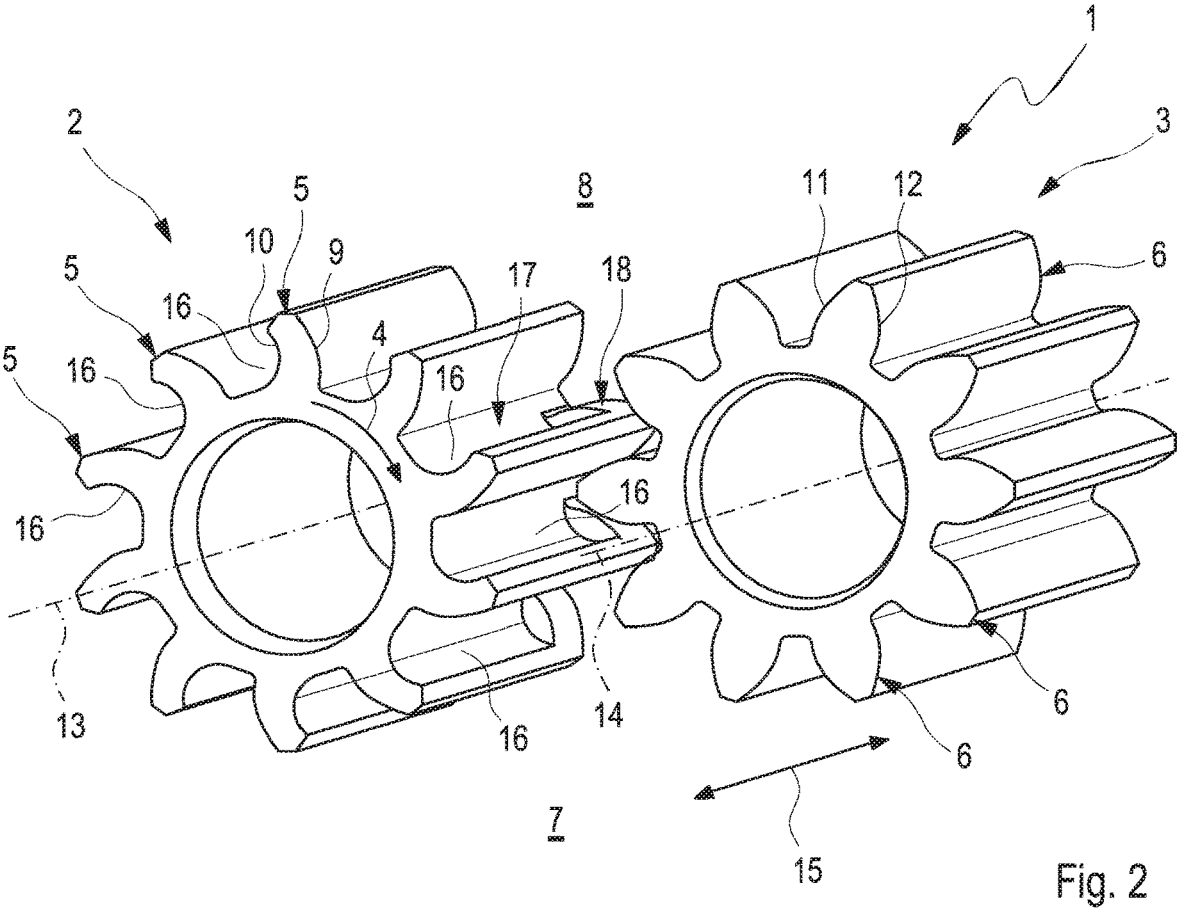
FIG. 2 the region of the external gear pump, wherein the two pump gears are present in a second position relative to each other.

FIG. 2 shows the region of the external gear pump 1, that is, the two pump gears 2 and 3, in a second axial position of the pump gears 2 and 3 relative to each other. In particular, in this case, there exists a position in which the superposition between the pump gears 2 and 3 is minimal in the axial direction. The pump gears 2 and 3 are thereby arranged in such a way, however, that they do not become disengaged relative to each other in any position. Instead, the teeth 5 and 6 are intended to be engaged relative to each other in any possible position of the pump gears 2 and 3. It can clearly be seen that the fluid pocket 16 or the fluid pockets 16 each pass through the teeth 5 only in part in the axial direction, that is, is/are designed to be open-edge only on one side in the axial direction.

For this purpose, the trailing tooth flanks 10 each have a fluid pocket region 17 as well as a contact region 18. Whereas, in the fluid pocket region 17, the trailing tooth flank 10 extends concavely in the radial direction at least in sections, the trailing tooth flank 10 in the contact region 18 is convex at least in sections, that is, is arched in the direction facing away from the respective leading tooth flank 9. For example, in the contact region 18, the trailing tooth flank 10 is symmetric in form to the leading tooth flank 9. The dimensions of the contact region 18 in the axial direction are chosen in such a way that, also in the position of the two pump gears 2 and 3 relative to each other that is illustrated here, in which the minimum superposition is present, the contact region 18 is present in superposition with the second pump gear 3. The contact region 18 should therefore be present in superposition with the second pump gear 3 for each position of the pump gears 2 and 3 relative to each other.

In this way, a good reverse rotation ability of the external gear pump 1 and, in addition, a constant clearance in the circumferential direction between the pump gears 2 and 3, regardless of the superposition, are realized. The clearance can be equal to zero, for example. Alternatively, it is greater than zero and, with respect to one of the rotation axes 13 and 14, for example, it is at most 0.1°, at most 0.25°, at most 0.5°, at most 0.75°, at most 1°, at most 2.5°, or at most 5°. It can also lie between two of the values mentioned; that is, it can be, for example, at least 0.25° and at most 0.75°.

Figure 3:
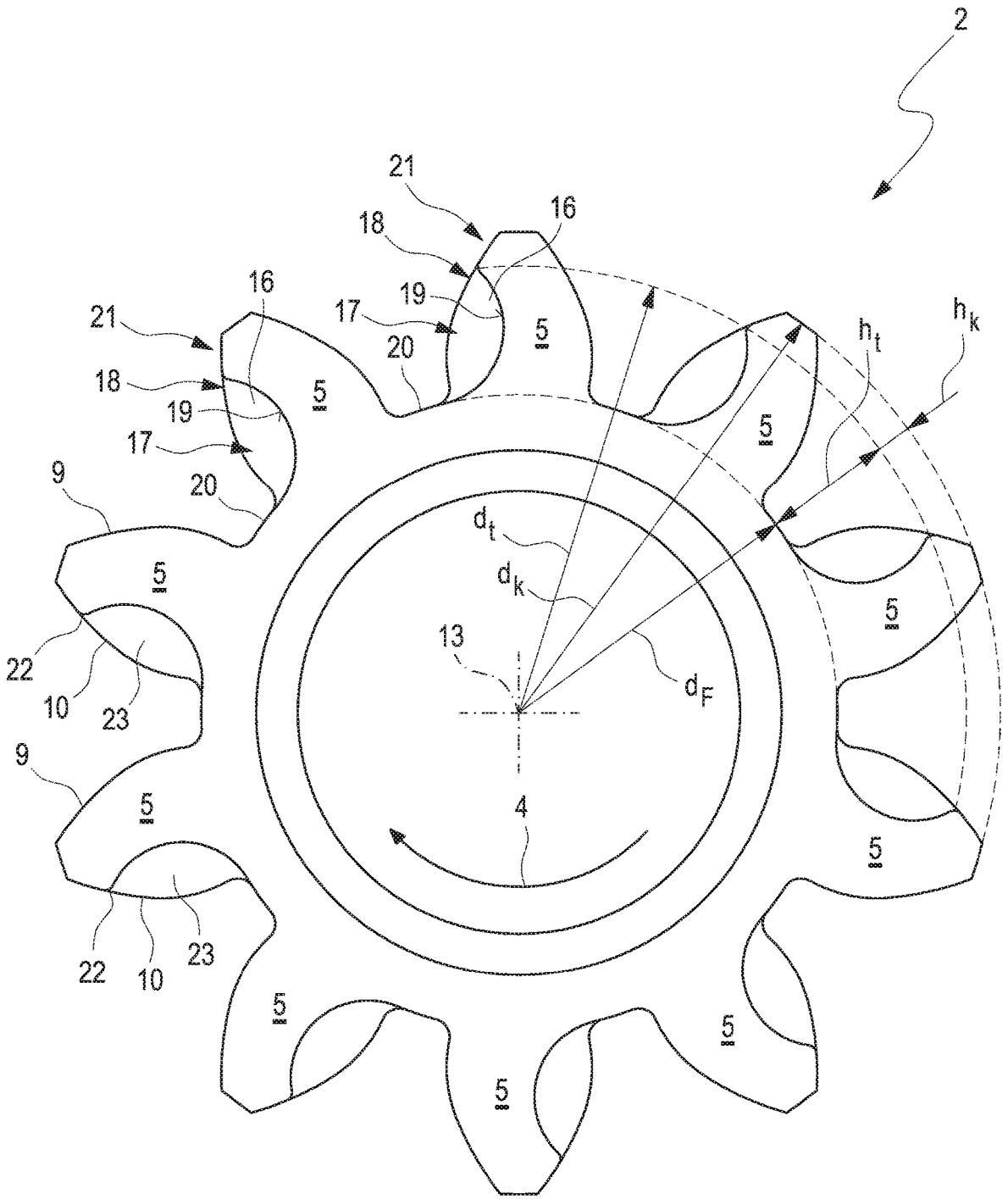
FIG. 3 a cross-sectional illustration of the first pump gear.

FIG. 3 shows a cross-sectional illustration of the first pump gear 2. It can be seen that the fluid pocket 16 is delimited in the circumferential direction by a tooth flank edge or wall region 19. As viewed in cross section, the tooth flank wall region 19 preferably takes the form of a segment of a circle. The tooth flank wall region 19 in this case preferably extends from a tooth root circle 20, which is present in each case between two teeth 5 of the pump gear 2, all the way to a tip region 21 of the respective tooth 5.

The tooth root circle 20 has a tooth root circle diameter $d_f$. A tip circle diameter is indicated as $d_k$ in the exemplary embodiment illustrated here. The difference between the tip circle diameter $d_k$ and the tooth root circle diameter $d_f$ corresponds to twice the tooth height h, which is not illustrated here. Therefore, $d_k - d_f = 2\,h$ applies. In the embodiment of the external gear pump 1 shown here, the tooth height h is composed of a pocket height $h_t$ and a tip region height $h_k$ of the tip region 21. As a result, the fluid pocket 16, in turn, directly adjoins the tooth root circle 20 in the radial direction. Especially preferred, the fluid pocket 16 or the tooth flank wall region 19 delimiting the fluid pocket 16 extends directly out of the tooth root circle 20. Preferably, it extends tangentially out of the latter.

As viewed in cross section, in this case, the tooth flank wall region 19 can take the form of a segment of a circle, in particular over its entire extent or at least a large part of its extent in the radial direction, in particular over at least 50%, at least 75%, at least 80%, at least 85%, at least 90%, or at least 100%. On the side that faces away from the tooth root circle 20, the tooth flank wall region 19 extends out of the tip region 21 or transitions into it. The transition can be made via a rounding 22, for example, in order to attain a high strength of the first pump gear 2. The dimension $h_k$ of the tip region 21 is at least 5% in relation to half of the difference between the tip circle diameter $d_k$ and the tooth root diameter $d_f$, but it can also be greater. It is clearly seen here once again that, in the first pump gear 2, the fluid pocket 16 is formed open-edge only on one side. On one side, as viewed in the axial direction, said fluid pocket is delimited by the wall 23 formed by the contact region 18.

Figure 4:
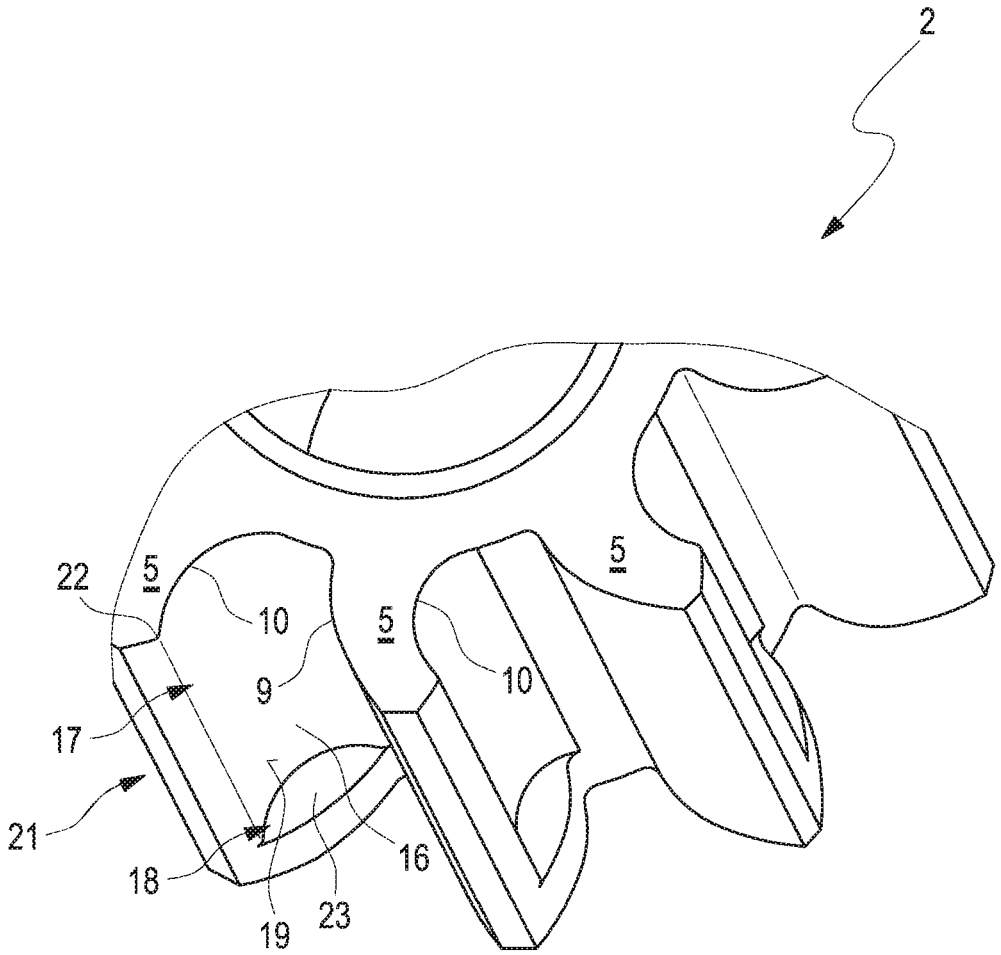
FIG. 4 a detailed illustration of a region of the first pump gear.

FIG. 4 shows a detailed illustration of a region of the first pump gear 2. Clearly seen here is the rounding 22, via which the tooth flank wall region 19 transitions into the tip region 21. The rounding 22 can be a part of the tooth flank wall region 19 or of the tip region 21. The embodiment of the external gear pump 1 presented here exhibits an extremely small cavitation tendency, because fluid that has been forced into the fluid pocket 16 can leave it in the axial direction at least in part. At the same time, however, the reverse rotation capability of the external gear pump 1 and a constant clearance in the circumferential direction are ensured, regardless of the superposition, by the presence of the contact region 18.

The invention claimed is:

1. An external gear pump, comprising:

a driving first pump gear and a second pump gear driven by the first pump gear, which intermesh to convey a fluid from a suction side to a pressure side of the external gear pump, wherein the first pump gear and the second pump gear each have a plurality of teeth, each having a leading tooth flank leading in the rotation direction of the corresponding pump gear and a trailing tooth flank, wherein the leading tooth flank of the first pump gear comes into physical contact with the trailing tooth flank of the second pump gear to drive the second pump gear via the first pump gear, wherein the trailing tooth flanks of the first pump gear extend concavely to form a fluid pocket at at least one axial position in a radial direction at least in sections in each case, wherein the fluid pocket extends directly out of a tooth root circle of the first pump gear, and wherein a cross-section of the trailing tooth flanks is identical throughout in the region of the fluid pocket, in the axial direction.

2. The external gear pump according to claim 1, wherein the trailing tooth flanks of the teeth of the second pump gear are symmetric in design to the leading tooth flanks of the teeth of the second pump gear.

3. The external gear pump according to claim 1, wherein as viewed in the axial direction, the fluid pocket in the respective trailing tooth flank of the first pump gear is formed open-edge at least on one side.

4. The external gear pump according to claim 1, wherein as viewed in the axial direction, the trailing tooth flanks of the first pump gear each have a fluid pocket region, which accommodates the fluid pocket, as well as a contact region, which directly adjoins the fluid pocket region, wherein the trailing tooth flanks extend convexly in the contact region.

5. The external gear pump according to claim 4, wherein the first pump gear and the second pump gear are shiftable in position relative to each other in the axial direction with respect to a rotation axis of one of the pump gears to adjust a specific superposition, and wherein a contact region is present in superposition with the second pump gear for each position of the two pump gears relative to each other in the axial direction.

6. The external gear pump according to claim 4, wherein, in a contact region, the trailing tooth flanks extend symmetrically to the respective leading tooth flanks of the corresponding teeth.

7. The external gear pump according to claim 1, wherein a tooth flank wall region that delimits the fluid pocket of the respective trailing tooth flank of the first pump gear extends directly from the tooth root circle, and wherein, as viewed in the cross section, the tooth flank wall region delimits the fluid pocket in the circumferential direction.

8. The external gear pump according to claim 7, wherein the teeth of the first pump gear each have a tip region, in which the trailing tooth flank is convex, and wherein a tooth height of the teeth of the first pump gear is composed of a pocket height of the fluid pocket and a tip region height of the tip region, the tooth height being greater than the pocket height.

9. The external gear pump according to claim 8, wherein in relation to the difference between tip circle radius and root circle radius of the teeth of the first pump gear, the dimensions of the tip region in the radial direction are at least 5%, at least 10%, at least 15%, at least 20%, at least 25%, at least 30%, at least 35%, or at least 40%.

10. The external gear pump according to claim 8, wherein the tooth flank wall region adjoins the tip region via a rounding.

11. The external gear pump according to claim 8, wherein, in the tip region, the trailing tooth flank is symmetric in form to the corresponding leading tooth flank.

12. The external gear pump according to claim 7, wherein as viewed in the cross section, the tooth flank wall region takes the form of a segment of a circle.

13. The external gear pump according to claim 7, wherein the tooth flank wall region that delimits the fluid pocket of the respective trailing tooth flank of the first pump gear extends tangentially out of the tooth root circle.

14. The external gear pump according to claim 1, wherein as viewed in the axial direction, the fluid pocket in the respective trailing tooth flank of the first pump gear is formed open-edge only on one side.

* * * * *